US007552487B2

(12) United States Patent
Chen

(10) Patent No.: US 7,552,487 B2
(45) Date of Patent: Jun. 30, 2009

(54) BOTTOM BRACKET OF PLAYPEN

(76) Inventor: Owen Chen, 284, Min Chuan West Rd., Tatung, Taipei (TW)

( * ) Notice: Subject to any disclaimer, the term of this patent is extended or adjusted under 35 U.S.C. 154(b) by 581 days.

(21) Appl. No.: 11/320,237

(22) Filed: Dec. 28, 2005

(65) Prior Publication Data

US 2007/0145218 A1 Jun. 28, 2007

(51) Int. Cl.
*A47D 47/00* (2006.01)
*E04G 3/00* (2006.01)

(52) U.S. Cl. ..... 5/99.1; 5/93.1; 248/292.12; 248/292.13

(58) Field of Classification Search ..... 5/99.1, 5/93.1, 98.1, 99.3; 16/320, 370; 248/262, 248/263, 253, 291.1, 292.12, 292.13, 251, 248/166, 434, 435; 280/651, 652, 642, 647; 403/102, 218

See application file for complete search history.

(56) References Cited

U.S. PATENT DOCUMENTS 6,202,229 B1 * 3/2001 Cheng ..... 5/99.1
6,336,234 B1 * 1/2002 Kuo ..... 5/99.1
6,349,434 B1 * 2/2002 Zhuang ..... 5/99.1
6,364,563 B1 * 4/2002 Cheng ..... 403/102
6,698,042 B2 * 3/2004 Cheng ..... 5/99.1
6,851,135 B1 * 2/2005 Chen ..... 5/99.1
6,869,096 B2 * 3/2005 Allen et al. ..... 280/642
7,237,795 B2 * 7/2007 Wu ..... 280/651
2006/0225209 A1 * 10/2006 Branch ..... 5/127

* cited by examiner

*Primary Examiner*—Amy J. Sterling
*Assistant Examiner*—Tan Le
(74) *Attorney, Agent, or Firm*—Alan Kamrath; Kamrath & Associates PA

(57) ABSTRACT

A bottom bracket of a playpen includes a support seat, and a rotation seat. The support seat includes two covers, a slide, a locking rod, a drive rod, an elastic member, a pull handle, and a pull strap. The rotation seat includes two pivot members and a limit plate. Thus, the user only needs to pull the pull strap upward so to fold the bottom bracket, so that the bottom bracket is folded easily and rapidly, thereby facilitating the user folding the bottom bracket. In addition, each of the two pivot members is locked by the locking rod exactly when the bottom bracket is expanded, thereby preventing the pivot members from being pivoted unintentionally, so that the bottom bracket is positioned rigidly and stably without detachment.

17 Claims, 10 Drawing Sheets

BOTTOM BRACKET OF PLAYPEN

BACKGROUND OF THE INVENTION

1. Field of the Invention

The present invention relates to a bottom bracket and, more particularly, to a bottom bracket of a playpen.

2. Description of the Related Art

A conventional playpen comprises a frame having a plurality of transverse rods and a plurality of upright rods, a plurality of joints mounted on an upper portion of the frame to expand and fold the upper portion of the frame, and a bottom bracket mounted on a lower portion of the frame to expand and fold the lower portion of the frame. However, the bottom bracket is not operated easily and conveniently, so that the lower portion of the frame cannot be folded easily and rapidly, thereby causing inconvenience to the user when folding the bottom bracket and the playpen. In addition, the mediate portion of the bottom bracket is easily sprung upward during the expanding process, so that the rods of the frame are folded unintentionally, thereby causing danger to the user when expanding the bottom bracket.

SUMMARY OF THE INVENTION

In accordance with the present invention, there is provided a bottom bracket of a playpen, comprising a support seat, and a rotation seat. The support seat includes two covers combined with each other and each having a lower portion formed with a through hole, a slide slidably mounted between the two covers, a locking rod extended through the slide and movable in a transverse manner between a first position where the locking rod is protruded outward from the through hole of a respective one of the two covers and a second position where the locking rod is refracted into the through hole of the respective cover, a drive rod movably mounted on the slide in an oblique manner and connected to the locking rod to move the locking rod in a transverse manner by movement of the slide. The rotation seat includes two pivot members each pivotally mounted on the covers of the support seat and each having a first side wall provided with a catch plate that is movable between a first position where the catch plate is stopped by the locking rod of the support seat when the locking rod is protruded outward from the through hole of the respective cover to stop pivot of the two pivot members and a second position where the catch plate is released from the locking rod of the support seat when the locking rod is retracted into the through hole of the respective cover so that the catch plates of the two pivot members are movable freely, and the two pivot members are pivotable freely.

The primary objective of the present invention is to provide a bottom bracket that is folded easily and conveniently.

Another objective of the present invention is to provide a bottom bracket of a playpen, wherein the user only needs to pull the pull strap upward so to fold the bottom bracket, so that the bottom bracket is folded easily and rapidly, thereby facilitating the user folding the bottom bracket.

A further objective of the present invention is to provide a bottom bracket of a playpen, wherein each of the two pivot members is locked by the locking rod exactly when the bottom bracket is expanded, thereby preventing the two pivot members from being pivoted unintentionally, so that the bottom bracket is positioned rigidly and stably without detachment.

A further objective of the present invention is to provide a bottom bracket of a playpen, wherein the mediate portion of the bottom bracket will not be sprung upward during the expanding process, thereby facilitating the user expanding the bottom bracket.

Further benefits and advantages of the present invention will become apparent after a careful reading of the detailed description with appropriate reference to the accompanying drawings.

DETAILED DESCRIPTION OF THE INVENTION

Figure 1:
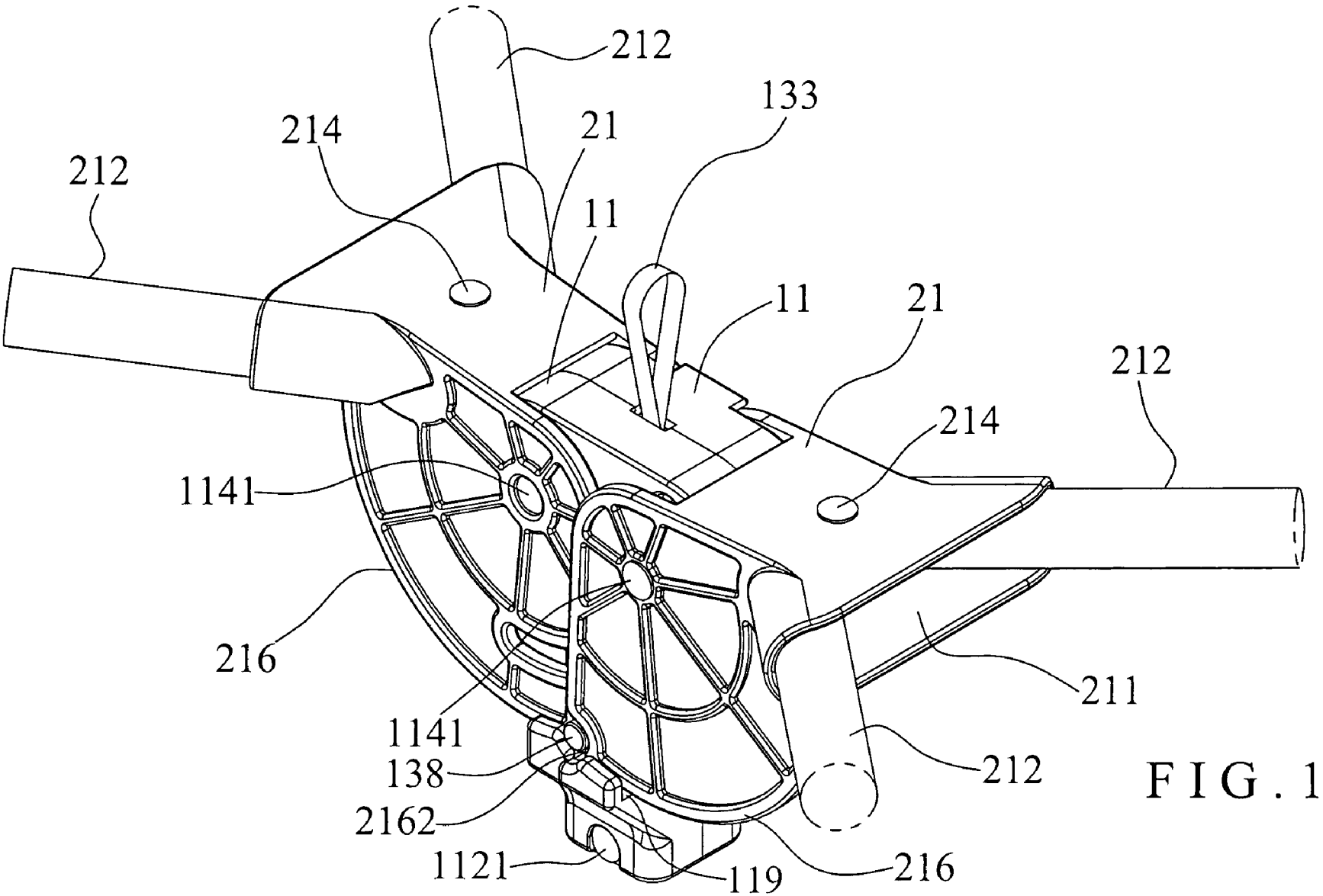
FIG. 1 is a front perspective view of a bottom bracket in accordance with the preferred embodiment of the present invention.
Figure 2:
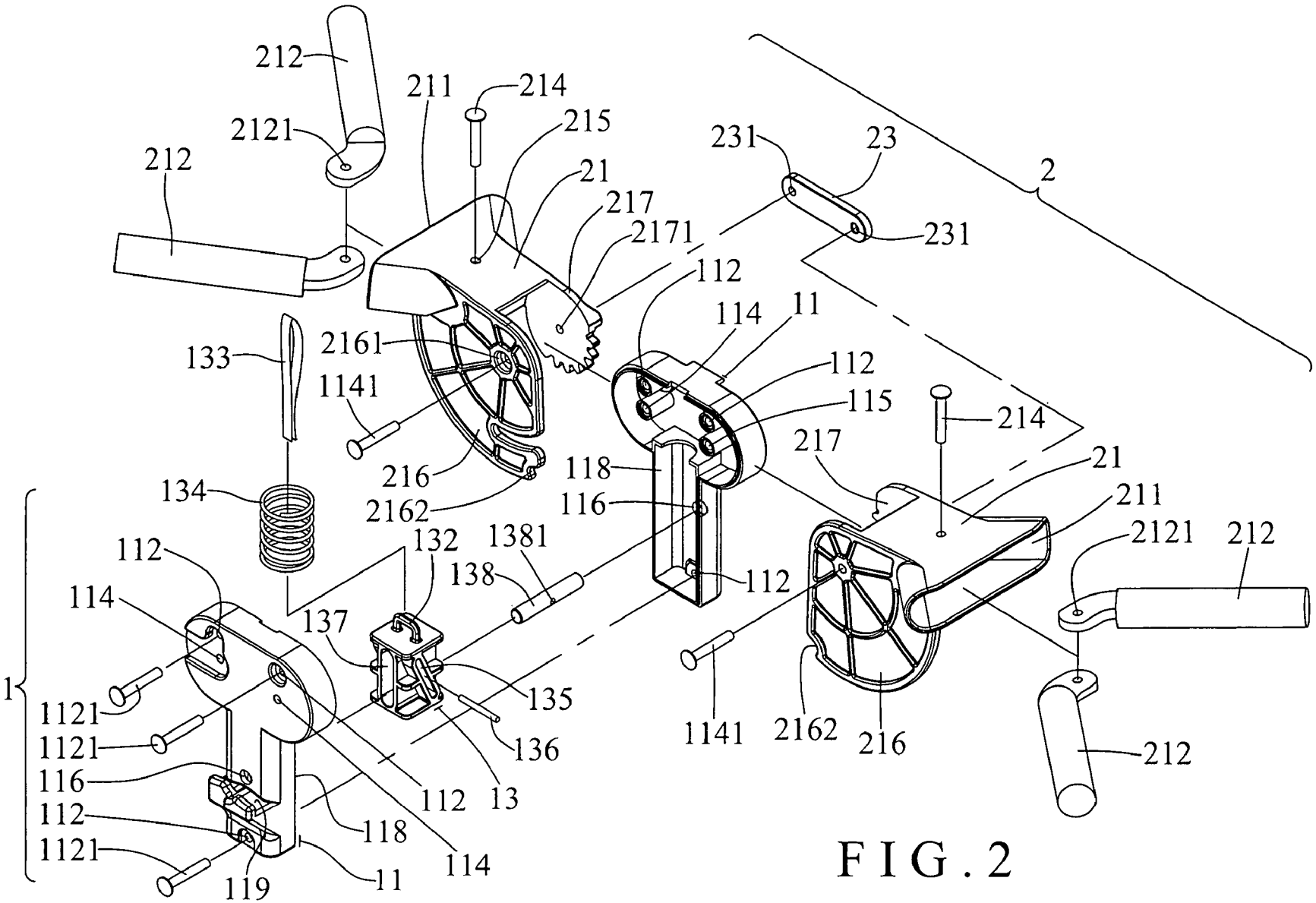
FIG. 2 is an exploded perspective view of the bottom bracket as shown in FIG. 1.

Referring to the drawings and initially to FIGS. 1-8, a bottom bracket of a playpen in accordance with the preferred embodiment of the present invention comprises a support seat 1, and a rotation seat 2.

The support seat 1 includes two covers 11 combined with each other and each having a lower portion formed with a through hole 116, a slide 13 slidably mounted between the two covers 11, a locking rod 138 extended through the slide 13 and movable in a transverse manner between a first position where the locking rod 138 is protruded outward from the through hole 116 of a respective one of the two covers 11 and a second position where the locking rod 138 is retracted into the through hole 116 of the respective cover 11, a drive rod 136 movably mounted on the slide 13 in an oblique manner and connected to the locking rod 138 to move the locking rod 138 in a transverse manner by movement of the slide 13, an elastic member 134 biased between the two covers 11 and the slide 13 to push the slide 13 downward relative to the two covers 11, a pull handle 132 mounted on an upper end of the slide 13 to pull the slide 13 upward relative to the two covers 11, and a pull strap 133 mounted on the pull handle 132 to pull the pull handle 132 and partially protruded outward from the two covers 11 to facilitate a user gripping the pull strap 133.

The two covers 11 of the support seat 1 are combined with each other by a plurality of fixing rivets 1121. Each of the two covers 11 is substantially T-shaped and has periphery formed with a plurality of fixing holes 112 to allow passage of the fixing rivets 1121. Each of the two covers 11 has an upper portion formed with two pivot holes 114. Each of the two covers 11 has an inside formed with a receiving chamber 118 to receive the slide 13. The lower portion of one of the two covers 11 is provided with a protruding limit block 119 located under the through hole 116. The slide 13 of the support seat 1 has an inside formed with an elongated slide slot 137 mounted on the locking rod 138 and has a side formed with an elongated oblique guide slot 135 mounted on the drive rod 136. The locking rod 138 of the support seat 1 is perpendicular to the drive rod 136 and has a mediate portion formed with a passage 1381 to allow passage of the drive rod 136.

The rotation seat 2 includes two pivot members 21 each pivotally mounted on the covers 11 of the support seat 1 and each having a first side wall provided with a sector-shaped catch plate 216 that is movable between a first position where the catch plate 216 is stopped by the locking rod 138 of the support seat 1 when the locking rod 138 is protruded outward from the through hole 116 of the respective cover 11 to stop pivot of the two pivot members 21 and a second position where the catch plate 216 is released-from the locking rod 138 of the support seat 1 when the locking rod 138 is retracted into the through hole 116 of the respective cover 11 so that the catch plates 216 of the two pivot members 21 are movable freely, and the two pivot members 21 are pivotable freely.

Each of the two pivot members 21 is provided with two support rods 212 pivotally connected with each other by a pivot pin 214 which is extended through a pivot bore 215 of each of the pivot members 21 and a pivot bore 2121 of each of the support rods 212. Each of the two pivot members 21 has an inside formed with a receiving chamber 211 to receive the two support rods 212. The catch plate 216 of each of the two pivot members 21 has an upper portion formed with a pivot hole 2161 and a lower portion formed with a locking hole 2162 locked onto the locking rod 138 of the support seat 1 when the locking rod 138 is protruded outward from the through hole 116 of the respective cover 11.

Each of the two pivot members 21 has a second side wall provided with a geared plate 217, and the geared plates 217 of the two pivot members 21 mesh with each other so that the two pivot members 21 are pivotable synchronously. The geared plate 217 of each of the two pivot members 21 is formed with a pivot hole 2171, and the support seat 1 further includes two pivot shafts 1141 each extended through the pivot hole 2161 of the catch plate 216 of a respective one of the two pivot members 21, a respective one of the two pivot holes 114 of each of the two covers 11 and the pivot hole 2171 of the geared plate 217 of the respective pivot member 21, so that each of the two pivot members 21 is pivotally mounted on the covers 11 of the support seat 1.

The rotation seat 2 further includes a limit plate 23 mounted on the two pivot shafts 1141 and rested on the geared plate 217 of each of the two pivot members 21 to limit movement of the geared plate 217 of each of the two pivot members 21. The limit plate 23 has two ends each formed with a mounting hole 231 mounted on a respective one of the two pivot shafts 1141. The geared plate 217 of each of the two pivot members 21 is provided with a protruding limit portion 2172 that is rested on the limit plate 23 when the two pivot members 21 and the respective support rods. 212 are disposed at a horizontal state as shown in FIG. 6.

Figure 3:
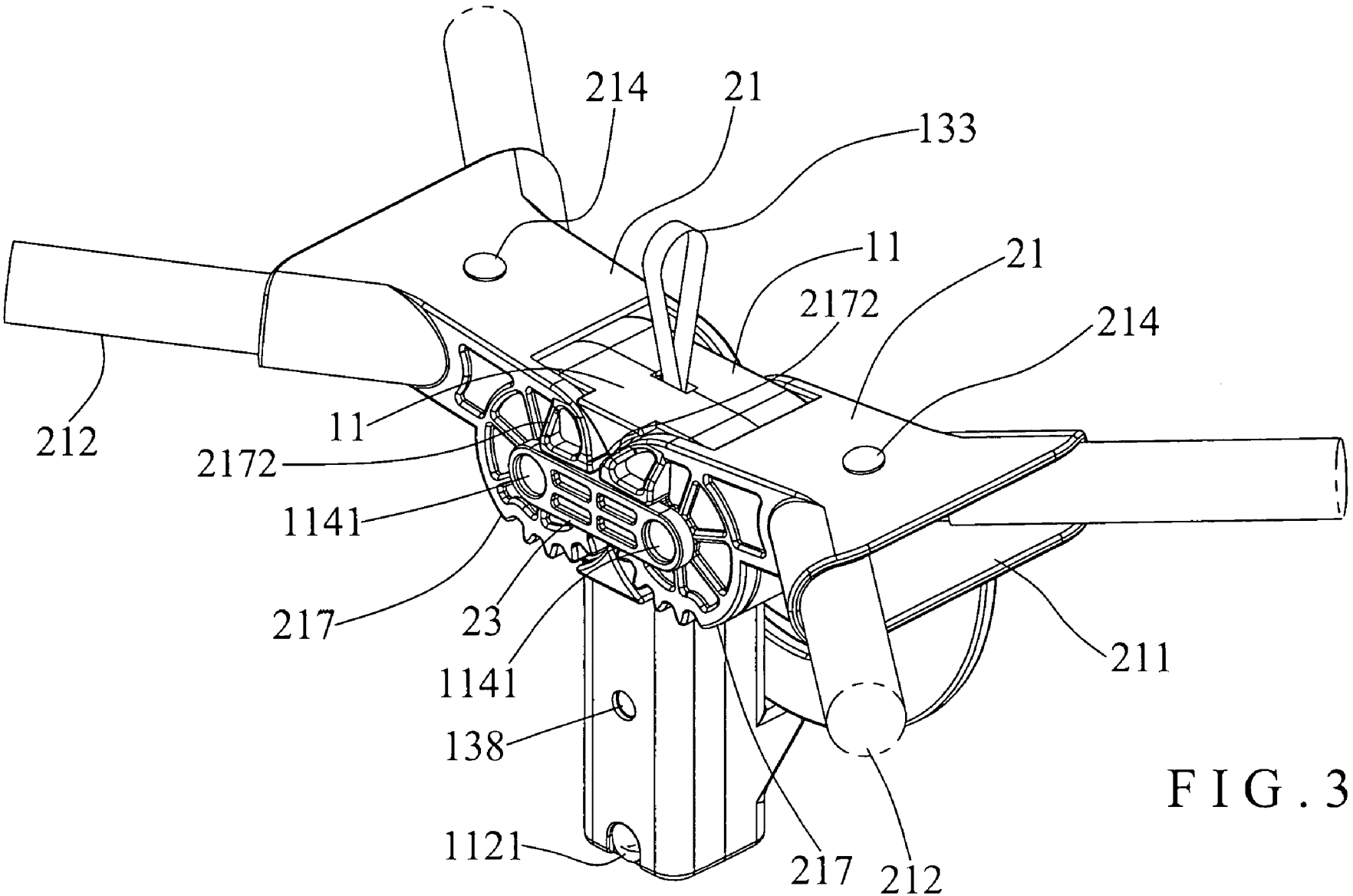
FIG. 3 is a rear perspective view of the bottom bracket as shown in FIG. 1.
Figure 4:
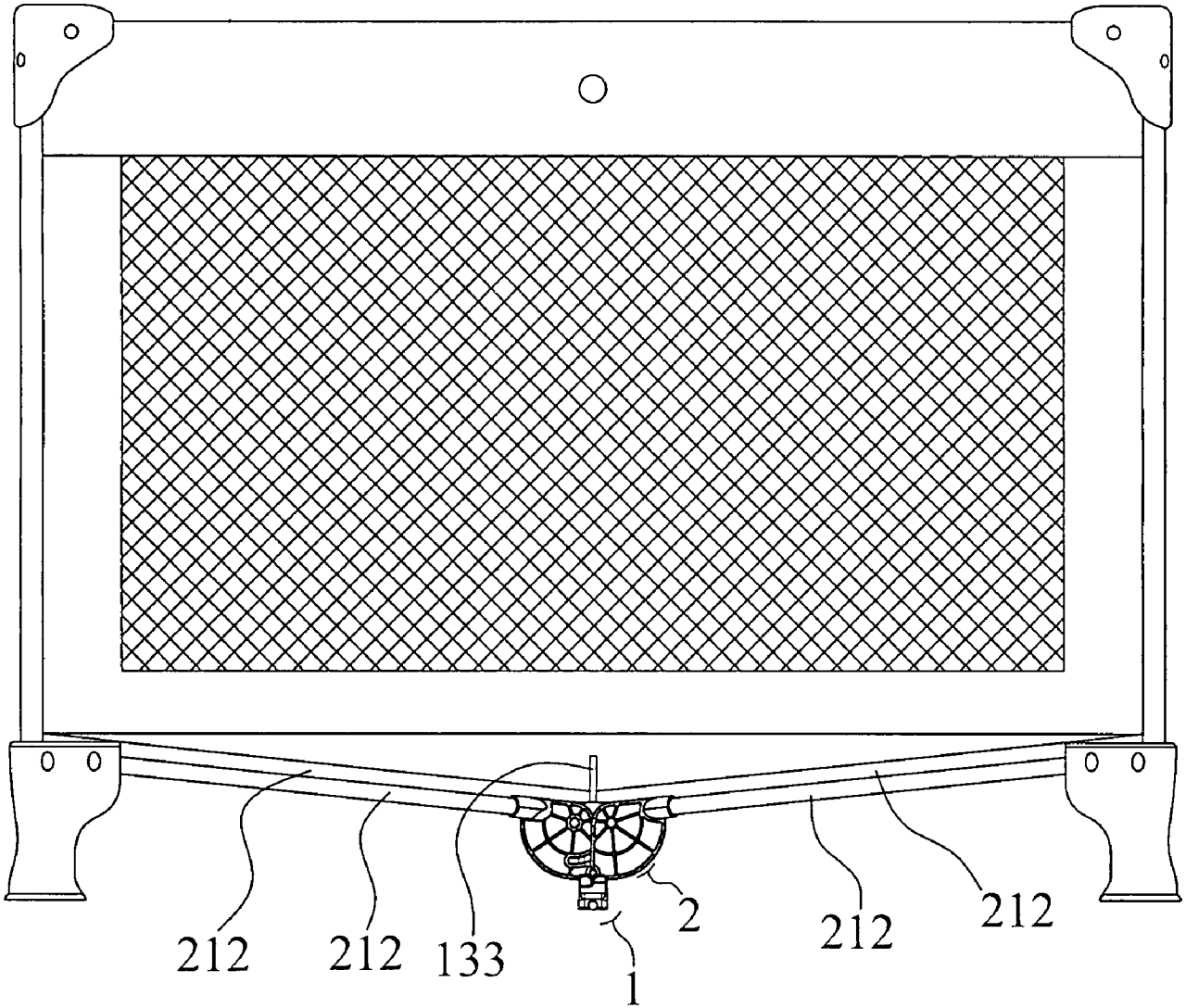
FIG. 4 is a plan view of the bottom bracket for a playpen as shown in FIG. 1.
Figure 5:
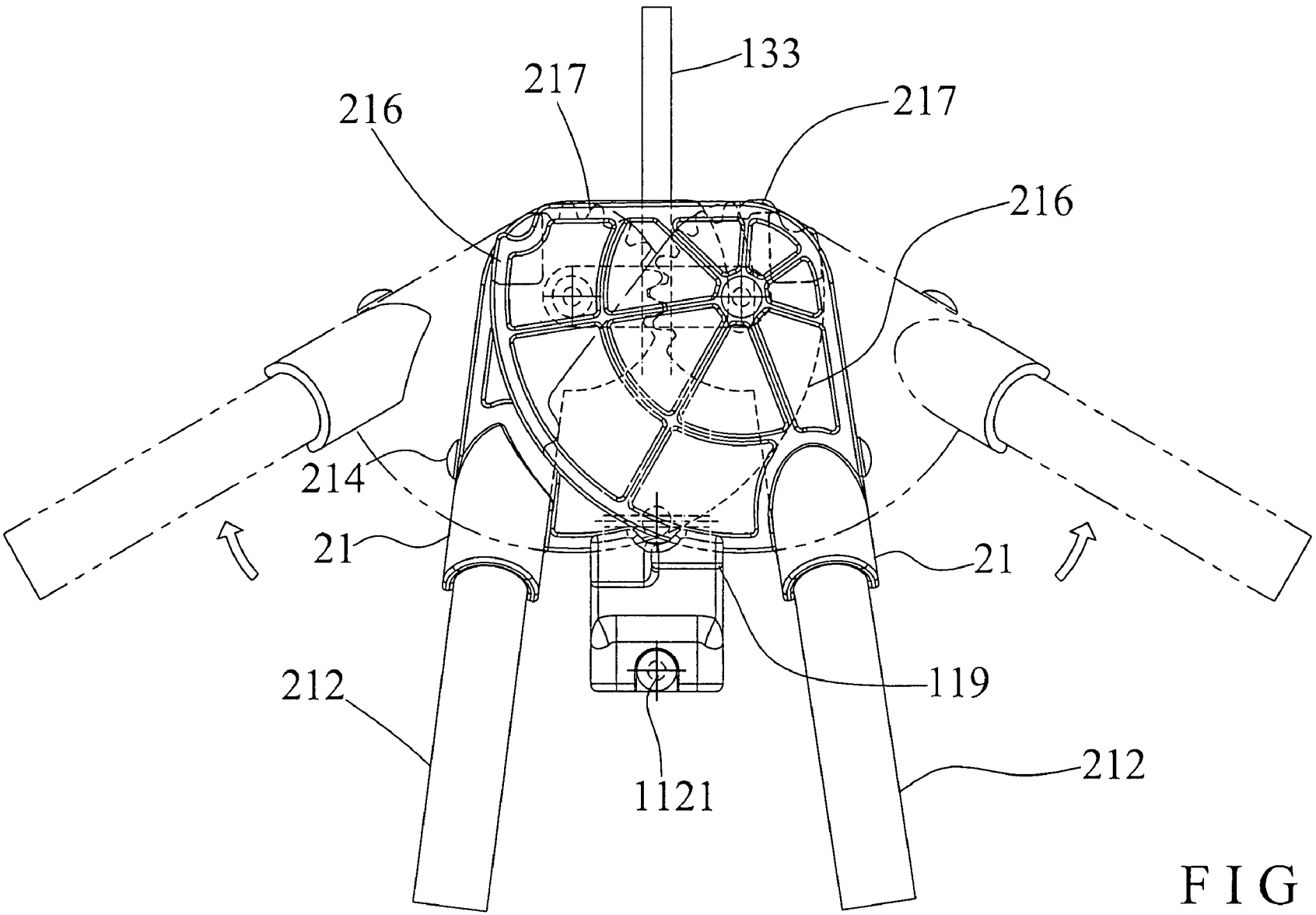
FIG. 5 is a plan operational view showing expanding of the bottom bracket as shown in FIG. 1.
Figure 6:
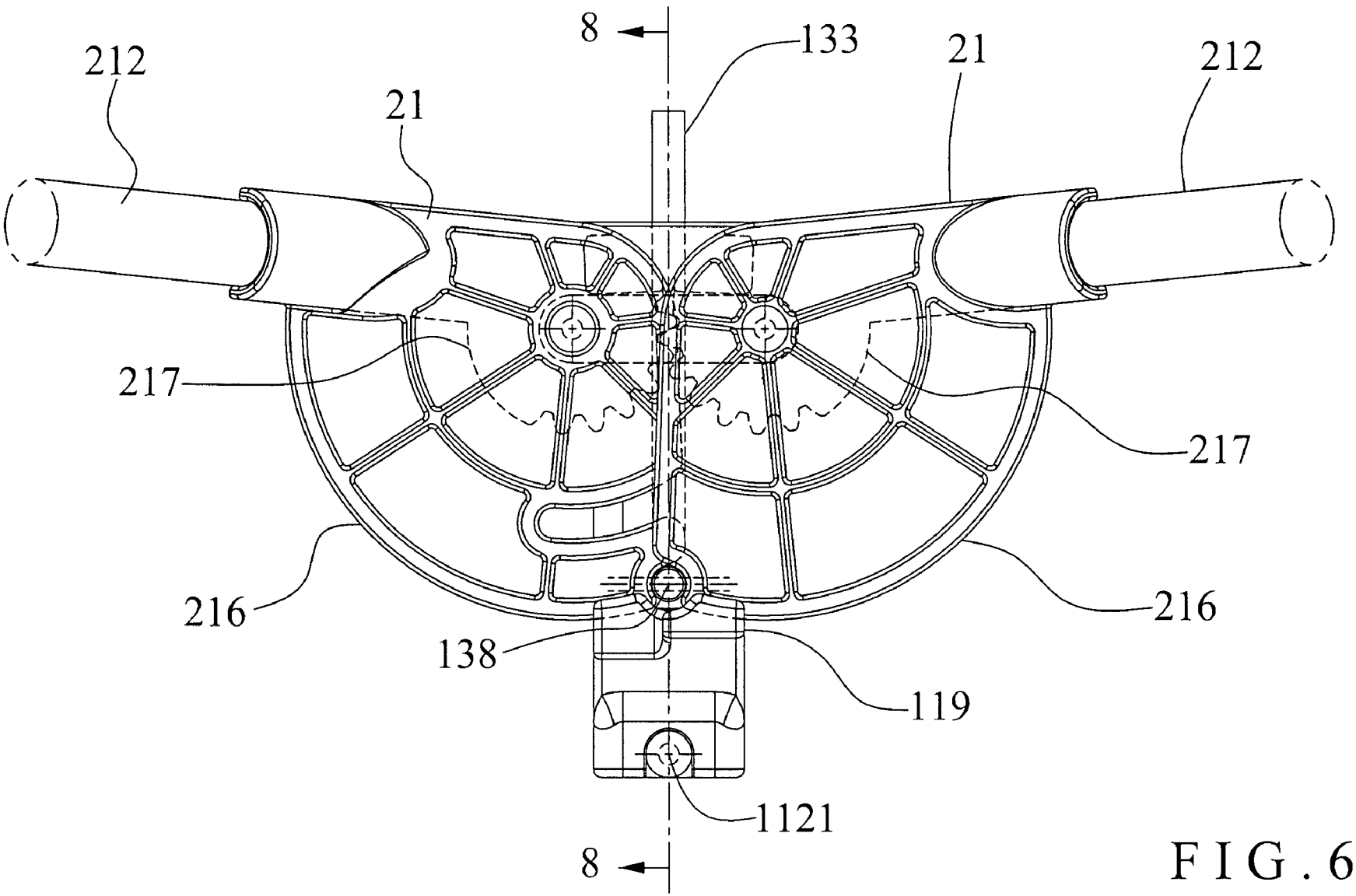
FIG. 6 is a schematic operational view of the bottom bracket as shown in FIG. 5.
Figure 7:
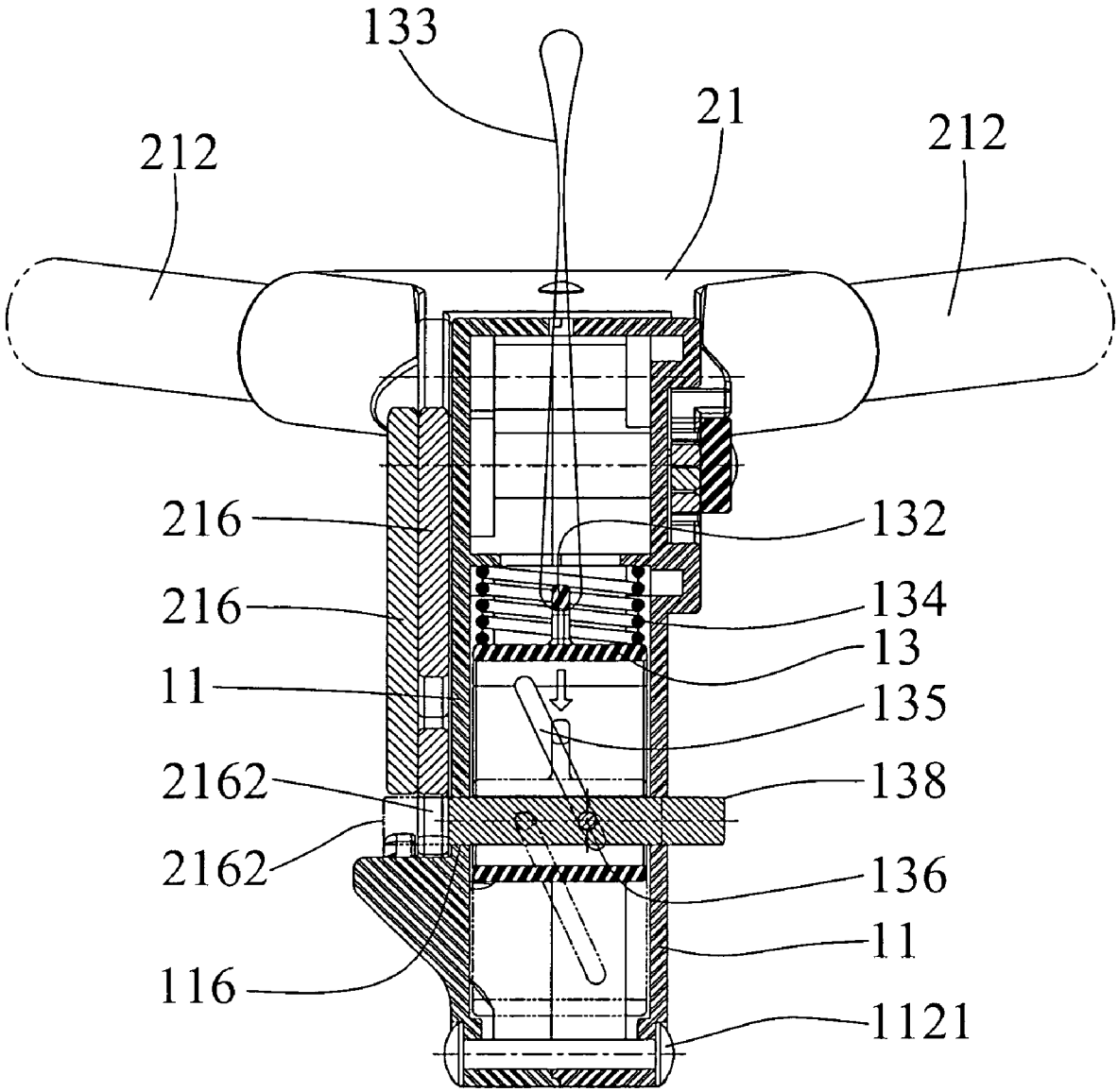
FIG. 7 is a plan cross-sectional operational view of the bottom bracket as shown in FIG. 1.
Figure 8:
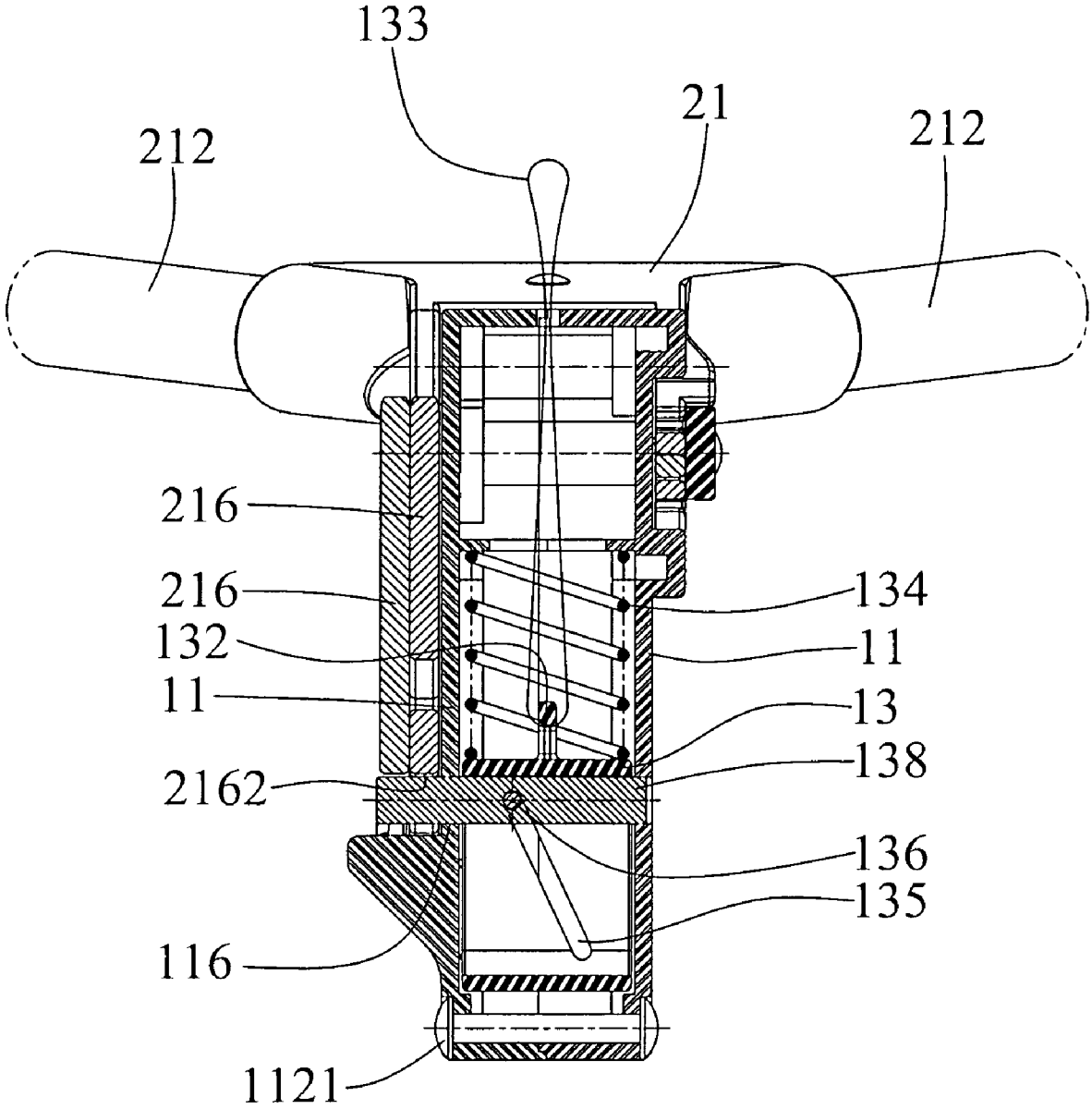
FIG. 8 is a schematic operational view of the bottom bracket as shown in FIG. 7.

In operation, referring to FIGS. 1-10, when the support rods 212 are moved upward from the position as shown in FIG. 5 to the position as shown in FIG. 6, the two pivot members 21 and the respective support rods 212 are disposed at a horizontal state so as to expand the bottom bracket, and the limit portion 2172 of the geared plate 217 of each of the two pivot members 21 is rested on the limit plate 23 as shown in FIG. 3. In such a manner, the elastic member 134 pushes the slide 13 downward which moves the drive rod 136 forward by guidance of the oblique guide slot 135 to drive the locking rod 138 to move forward from the position as shown in FIG. 7 to the position as shown in FIG. 8, where the locking rod 138 is protruded outward from the through hole 116 of a front cover 11 and is locked in the locking hole 2162 of the catch plate 216 of each of the two pivot members 21 as shown in FIG. 1 so as to lock the catch plate 216 of each of the two pivot members 21, such that each of the two pivot members 21 is locked by the locking rod 138 and cannot be pivoted any more.

Figure 9:
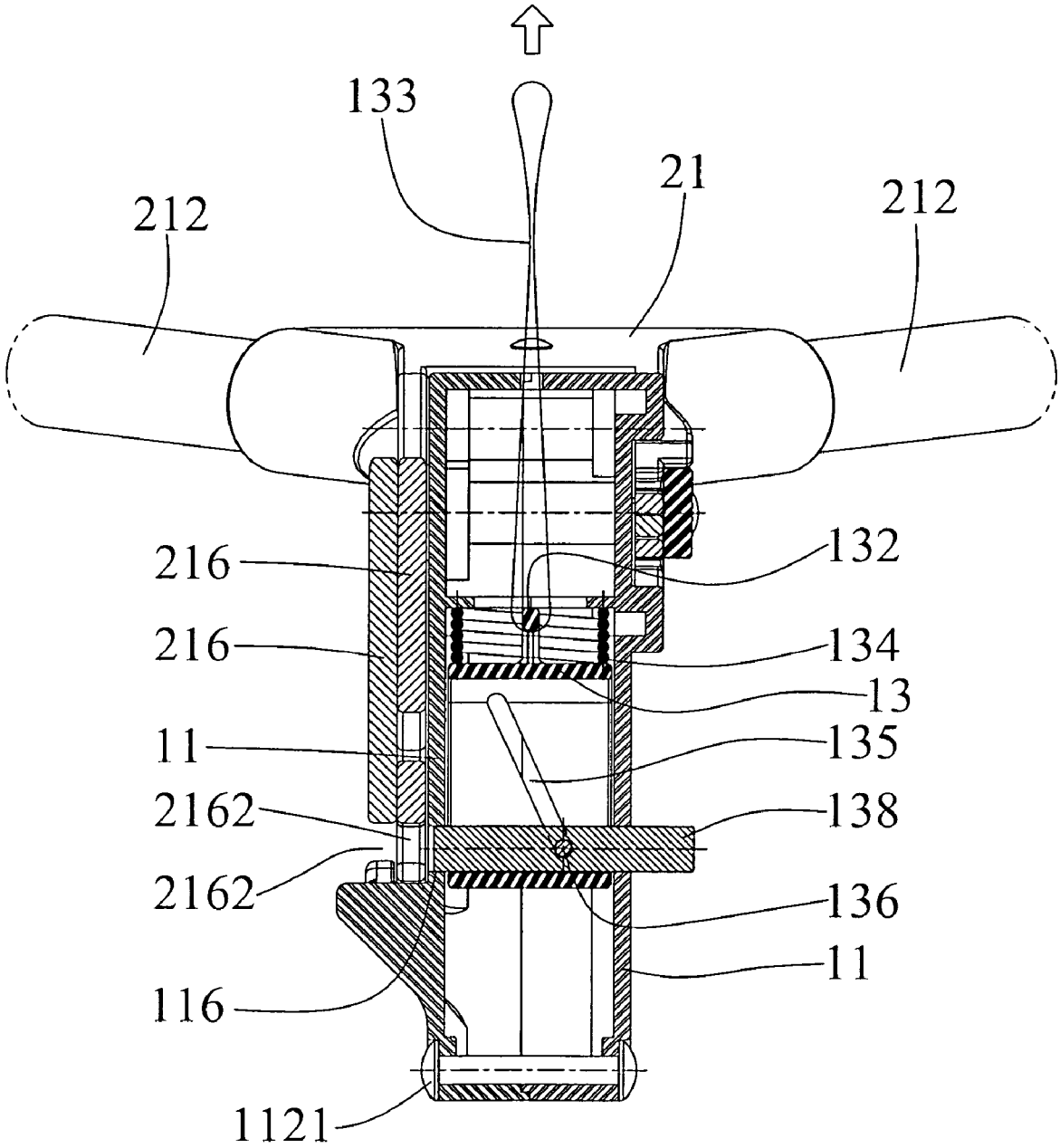
FIG. 9 is a schematic operational view of the bottom bracket as shown in FIG. 8.
Figure 10:
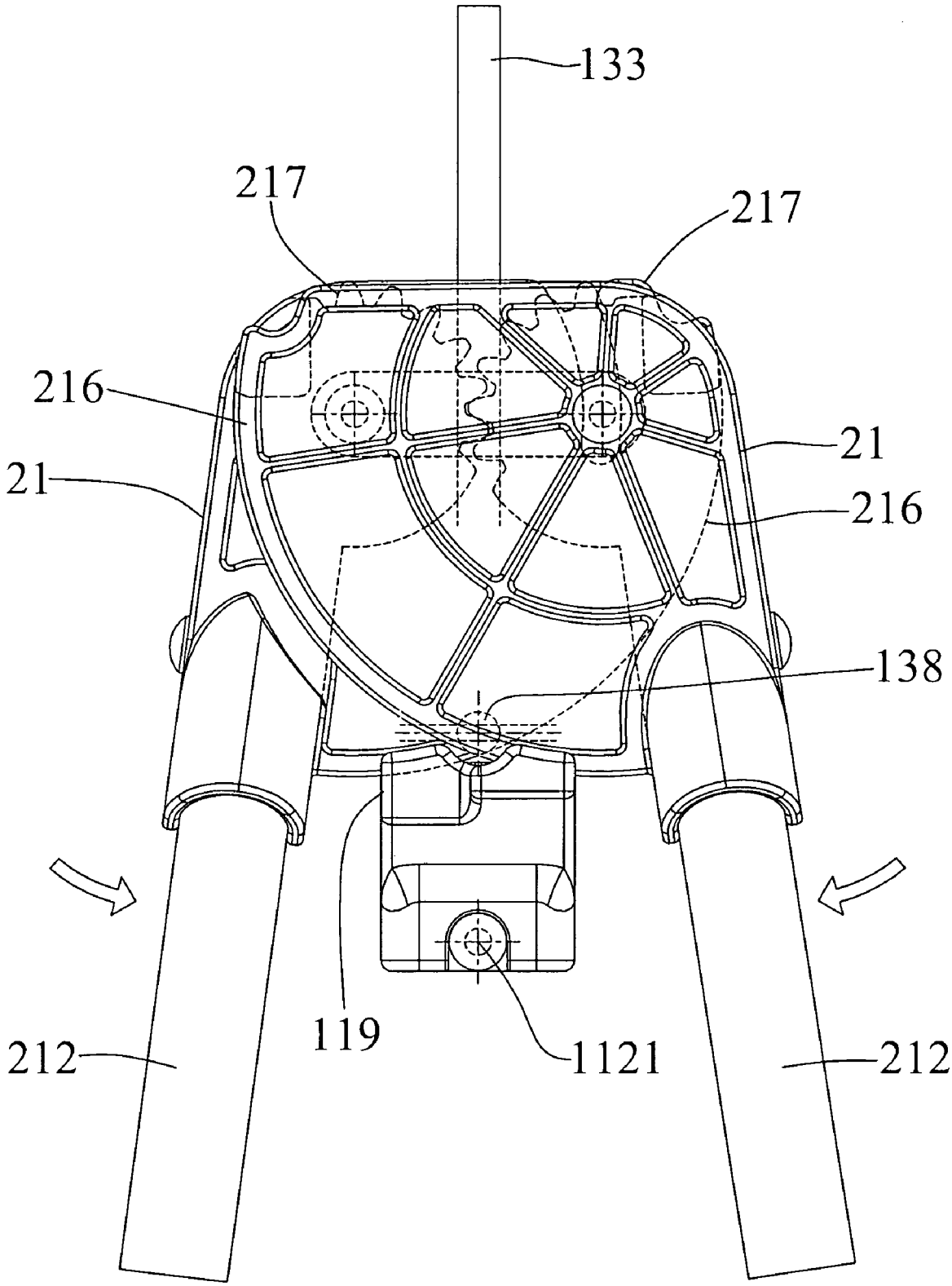
FIG. 10 is a plan folded view of the bottom bracket as shown in FIG. 1.

When the user wishes to fold the bottom bracket, the pull strap 133 is pulled upward to pull the pull handle 132 which moves the slide 13 upward to overcome the elastic force of the elastic member 134 so as to move the drive rod 136 backward by guidance of the oblique guide slot 135 to drive the locking rod 138 to move backward from the position as shown in FIG. 8 to the position as shown in FIG. 9, where the locking rod 138 is retracted into the through hole 116 of a front cover 11 and is detached from the locking hole 2162 of the catch plate 216 of each of the two pivot members 21 as shown in FIG. 9 so as to unlock the catch plate 216 of each of the two pivot members 21, such that each of the two pivot members 21 is unlocked from the locking rod 138 and is pivotable freely to move the respective support rods 212 downward so to fold the bottom bracket as shown in FIG. 10.

Accordingly, the user only needs to pull the pull strap 133 upward so to fold the bottom bracket, so that the bottom bracket is folded easily and rapidly, thereby facilitating the user folding the bottom bracket. In addition, each of the two pivot members 21 is locked by the locking rod 138 exactly when the bottom bracket is expanded, thereby preventing the two pivot members 21 from being pivoted unintentionally, so that the bottom bracket is positioned rigidly and stably without detachment. Further, the mediate portion of the bottom bracket will not be sprung upward during the expanding process, thereby facilitating the user expanding the bottom bracket.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A bottom bracket of a playpen, comprising a support seat, and a rotation seat, wherein:

the support seat includes two covers combined with each other and each having a lower portion formed with a through hole, a slide slidably mounted between the two covers, a locking rod extended through the slide and movable in a transverse manner between a first position where the locking rod is protruded outward from the through hole of a respective one of the two covers and a second position where the locking rod is retracted into the through hole of the respective cover, a drive rod movably mounted on the slide in an oblique manner and connected to the locking rod to move the locking rod in a transverse manner by movement of the slide;

the rotation seat includes two pivot members each pivotally mounted on the covers of the support seat and each having a first side wall provided with a catch plate that is movable between a first position where the catch plate is stopped by the locking rod of the support seat when the locking rod is protruded outward from the through hole of the respective cover to stop pivot of the two pivot members and a second position where the catch plate is released from the locking rod of the support seat when the locking rod is retracted into the through hole of the respective cover so that the catch plates of the two pivot members are movable freely, and the two pivot members are pivotable freely;

the drive rod is movable in the two covers;

the slide of the support seat has a side formed with an elongated oblique guide slot mounted on the drive rod so that the drive rod is movable in the elongated oblique guide slot of the slide in an oblique manner by movement of the slide;

the locking rod of the support seat is perpendicular to the drive rod;

the locking rod of the support seat has a mediate portion formed with a passage to allow passage of the drive rod so that the drive rod is connected to the locking rod by the passage, and the locking rod is movable with the drive rod;

the locking rod is extended through the through hole of the respective cover so that the locking rod is movable with the drive rod in a transverse manner by limit of the through hole of the respective cover and is movable to protrude outward from or retract into the through hole of the respective cover.

2. The bottom bracket in accordance with claim 1, wherein the support seat further includes an elastic member biased between the two covers and the slide to push the slide downward relative to the two covers, a pull handle mounted on an upper end of the slide to pull the slide upward relative to the two covers, and a pull strap mounted on the pull handle to pull the pull handle and partially protruded outward from the two covers to facilitate a user gripping the pull strap.

3. The bottom bracket in accordance with claim 1, wherein each of the two covers is substantially T-shaped.

4. The bottom bracket in accordance with claim 1, wherein the two covers of the support seat are combined with each other by a plurality of fixing rivets.

5. The bottom bracket in accordance with claim 4, wherein each of the two covers has periphery formed with a plurality of fixing holes to allow passage of the fixing rivets.

6. The bottom bracket in accordance with claim 1, wherein each of the two covers has an inside formed with a receiving chamber to receive the slide.

7. The bottom bracket in accordance with claim 1, wherein the slide of the support seat has an inside formed with an elongated slide slot mounted on the locking rod.

8. The bottom bracket in accordance with claim 1, wherein each of the two pivot members is provided with two support rods pivotally connected with each other by a pivot pin which is extended through a pivot bore of each of the pivot members and a pivot bore of each of the support rods.

9. The bottom bracket in accordance with claim 8, wherein each of the two pivot members has an inside formed with a receiving chamber to receive the two support rods.

10. The bottom bracket in accordance with claim 1, wherein the catch plate of each of the two pivot members has a lower portion formed with a locking hole locked onto the locking rod of the support seat when the locking rod is protruded outward from the through hole of the respective cover.

11. The bottom bracket in accordance with claim 1, wherein the catch plate of each of the two pivot members is sector-shaped.

12. The bottom bracket in accordance with claim 1, wherein each of the two pivot members has a second side wall provided with a geared plate, and the geared plates of the two pivot members mesh with each other so that the two pivot members are pivotable synchronously.

13. The bottom bracket in accordance with claim 12, wherein each of the two covers has an upper portion formed with two pivot holes, the catch plate of each of the two pivot members has an upper portion formed with a pivot hole, the geared plate of each of the two pivot members is formed with a pivot hole, and the support seat further includes two pivot shafts each extended through the pivot hole of the catch plate of a respective one of the two pivot members, a respective one of the two pivot holes of each of the two covers and the pivot hole of the geared plate of the respective pivot member, so that each of the two pivot members is pivotally mounted on the covers of the support seat.

14. The bottom bracket in accordance with claim 13, wherein the rotation seat further includes a limit plate mounted on the two pivot shafts and rested on the geared plate of each of the two pivot members to limit movement of the geared plate of each of the two pivot members.

15. The bottom bracket in accordance with claim 14, wherein the limit plate has two ends each formed with a mounting hole mounted on a respective one of the two pivot shafts.

16. The bottom bracket in accordance with claim 14, wherein the geared plate of each of the two pivot members is provided with a protruding limit portion that is rested on the limit plate when the two pivot members are disposed at a horizontal state.

17. The bottom bracket in accordance with claim 1, wherein the lower portion of one of the two covers is provided with a protruding limit block located under the through hole to limit the catch plate of each of the two pivot members.

* * * * *